US005357658A

United States Patent [19]

Tanaka

[11] Patent Number: 5,357,658

[45] Date of Patent: Oct. 25, 1994

[54] BUCKLE APPARATUS

[75] Inventor: Kohbun Tanaka, Aichi, Japan

[73] Assignee: Kabushiki Kaisha Tokai-Rika-Denki Seisakusho, Aichi, Japan

[21] Appl. No.: 33,554

[22] Filed: Mar. 18, 1993

[30] Foreign Application Priority Data

Mar. 23, 1992 [JP] Japan ..... 4-015148[U]
Mar. 23, 1992 [JP] Japan ..... 4-015149[U]

[51] Int. Cl.[5] ..... A44B 11/25
[52] U.S. Cl. ..... 24/641; 24/633
[58] Field of Search ..... 24/633, 641, 637, 640, 24/645

[56] References Cited

U.S. PATENT DOCUMENTS 4,727,630 3/1988 Alan ..... 24/633 X
4,972,559 11/1990 Haglund .
5,014,401 5/1991 Kitazawa ..... 24/641 X
5,054,171 8/1991 Tanaka ..... 24/641 X

FOREIGN PATENT DOCUMENTS 3-222904 10/1991 Japan .
3-277301 12/1991 Japan .
2173243A 10/1986 United Kingdom .
2202896 10/1988 United Kingdom ..... 24/633

*Primary Examiner*—Richard E. Gluck
*Attorney, Agent, or Firm*—Fisher & Associates

[57] ABSTRACT

A buckle apparatus includes a buckle body, a tongue plate, a lock plate supported by the buckle body, and being swingable between a first position for engaging the tongue plate and a second position for releasing the engagement, a lock pin moving in the tongue plate removal direction so as to prevent the lock plate from swinging toward the second position and moving in the tongue plate insertion direction so as to allow the lock plate to swing toward the second position, a release button pressing the holder so as to move the lock pin, teeth provided on the cover of the buckle body, and an engaging member being separated from the teeth in a state where the holder is in contact with the release button and engaging tile teeth so as to prevent the holder from moving in a state where the holder is separated from the release button.

19 Claims, 6 Drawing Sheets

BUCKLE APPARATUS

BACKGROUND OF THE INVENTION

1. Field of the Invention

The present invention relates to a buckle apparatus for use in a seat belt system, into which a tongue plate is inserted for engagement therewith.

2. Description of the Related Art

In buckle apparatus for use in seat belt systems, there is a buckle apparatus having a so-called locking bar structure in which a lock plate for engaging a tongue plate is moved in a direction intersecting a tongue plate insertion direction and a tongue plate removal direction so as to engage the tongue plate.

In the buckle apparatus having the locking bar structure, there is provided a lock pin for holding the lock plate in a tongue plate engaging state where the lock plate engages the tongue plate. The lock pin is provided to be movable between a locked position where the lock pin holds the lock plate in the tongue plate engaging state, and a release position where the lock plate can be released from the tongue engaging state. When the lock pin is positioned at the locked position, the lock plate is held in the tongue plate engaging state, resulting in a locked condition. On the other hand, when the lock pin is positioned at the release position, the lock plate can serve to release the tongue plate engaging state.

The lock pin is urged by a spring in a direction of the locked position. That is, when the lock pin is positioned at the locked position for holding the lock plate in the tongue plate engaging state, the lock pin is urged by the spring so as to be held in the locked position. Accordingly, it is possible to hold the lock pin in the locked position without inadvertently releasing the tongue plate engaging state of the lock plate.

In order to release the engagement of the tongue plate by the lock plate, a release button is pressed against the urging forces of a return spring for urging the release button and a spring for urging the lock pin so as to forcedly move the lock pin from the locked position to the release position. Thus, the lock plate releases the tongue plate engaging state so as to remove the tongue plate from the buckle apparatus.

In the buckle apparatus having the locking bar structure as set forth above, there is an advantage in that enhanced secureness can be obtained between the tongue plate and the buckle apparatus, resulting in reliable engagement.

The lock pin is moved in the same direction from the locked position to the release position (i.e., a spring urging direction) as the release button is pressed into. Hence, in order to block movement of the lock pin due to an inertial force, the urging force of the spring for urging the lock pin is simply increased, or additional spring is required so as to enhance the holding force of the lock pin. In these cases, however, a stronger operating force is required for pressing the release button to move the lock pin to the release position so as to release the engagement.

SUMMARY OF THE INVENTION

It is an object of the present invention to obtain a buckle apparatus which can reliably hold a lock plate in a tongue plate engaging state by a lock pin without requiring a strong operating force for releasing the engagement of the tongue plate.

According to one aspect of the present invention, there is provided a buckle apparatus including a buckle body covered with a cover, a tongue plate insertable into and removable from the buckle body, a lock plate supported by tile buckle body so as to engage the tongue plate inserted thereinto, the lock plate being swingable between a first position for engaging the tongue plate and a second position for releasing the engagement, a lock pin held by a holder and positioned in contact with the lock plate, the lock pin being movable in tongue plate insertion and removal directions, the lock pin moving in the tongue plate removal direction so as to prevent the lock plate from swinging toward the second position, and moving in the tongue plate insertion direction so as to allow the lock plate to swing toward the second position, a release button supported by the buckle body for pressing the holder to move the lock pin in the tongue plate insertion direction, teeth provided on one of the cover and the buckle body, an engaging claw member attached to the holder and being engagable with the teeth, and means for engaging the engaging member with the teeth when inertial force acts to move the lock pin in the tongue plate insertion direction.

According to another aspect of the present invention, there is provided a buckle apparatus including a buckle body covered with a cover, a tongue plate insertable into and removable from the buckle body, a lock plate supported by the buckle body so as to engage the tongue plate inserted thereinto, the lock plate being swingable between a first position for engaging the tongue plate and a second position for releasing the engagement, a lock pin positioned in contact with the lock plate, the lock pin being movable in tongue plate insertion and removal directions, the lock pin moving in the tongue plate removal direction so as to prevent the lock plate from swinging toward the second position, and moving in the tongue plate insertion direction so as to allow the lock plate to swing toward the second position, a lock pin holder for holding the lock pin, a release button supported by the buckle body for pressing the holder to move the lock pin in the tongue plate insertion direction, teeth provided on one of the cover and the buckle body, and an engaging member attached to the holder, said engaging member being separated from the teeth when the holder is substantially in contact with the release button, and engaging the teeth when the holder is separated from the release button.

According to one embodiment of the present invention, the engaging claw member is preferably a lever rotatably supported by a shaft to a side wall of the holder and provided on the side where a claw portion is opposed to a cam portion with the shaft interposed therebetween. In the embodiment of the present invention, the claw portion of the lever is urged in a direction for engaging the teeth. The lever is prevented from rotating by the cam portion contacting a projection provided on the release button so as to separate the claw portion from the teeth in a state where the holder is close to the release button. On the other hand, the cam portion is separated from the projection to engage the claw portion with the teeth so as to prevent the holder from moving in a state where the holder is separated from the release button. In particular, the cam portion of the engaging member is separated from the projection of the release button so as to engage the claw portion with the teeth when the lock pin is moved by an inertial force to a position for swinging the lock plate to the second position.

According to still another aspect of the present invention, there is provided a buckle apparatus including a buckle body covered with a cover, a tongue plate insertable into and removable from the buckle body, a lock plate supported by the buckle body so as to engage the tongue plate inserted thereinto, the lock plate being swingable between a first position for engaging the tongue plate and a second position for releasing the engagement, a lock pin positioned in contact with the lock plate, the lock pin being movable in tongue plate insertion and removal directions, the lock pin moving in the tongue plate removal direction so as to prevent the lock plate from swinging toward the second position, and moving in the tongue plate insertion direction so as to allow the lock plate to swing toward the second position, a lock pin holder for holding the lock pin, a release button supported by the buckle body for pressing the holder to move the lock pin in the tongue plate insertion direction, teeth provided on one of the cover and the buckle body, and an inertial claw member attached to the holder, and having a mass portion, the inertial claw member moving to engage the teeth when exerting an inertial force on the inertial claw member.

According to the embodiment of the present invention, the engaging member is preferably a lever rotatably supported by a shaft at a side wall of the holder and provided on the side where a mass portion is opposed to a claw portion with the shaft interposed therebetween. The claw portion of the lever is urged in the direction for engaging the teeth. The lever is prevented from rotating by the mass portion contacting the back portion of the release button so as to separate the claw portion from the teeth in a state where the holder is substantially in contact with the release button. On the other hand, the mass portion is rotated and moved by an inertial force to engage the claw portion with the teeth so as to prevent the holder from moving when inertial force is exerted in the tongue plate insertion direction.

According to the embodiment of the present invention, the lock plate includes a U-shaped portion bent downward in a U-shaped configuration at an end of the lock plate on a tongue plate inserting side, a rising portion bent upward at the other end thereof, and a connecting portion for connecting the U-shaped portion and the rising portion. A distal end of the U-shaped portion serves as an engaging portion for engaging an engaging hole of the tongue plate. The lock pin is positioned at an intermediate portion of the U-shaped portion when the lock plate is held in the first position, and the lock pin is positioned at the connecting portion when the lock plate is held in the second position.

The buckle apparatus of the present invention is suitable for seat belt systems.

DESCRIPTION OF THE PREFERRED EMBODIMENTS

Figure 1:
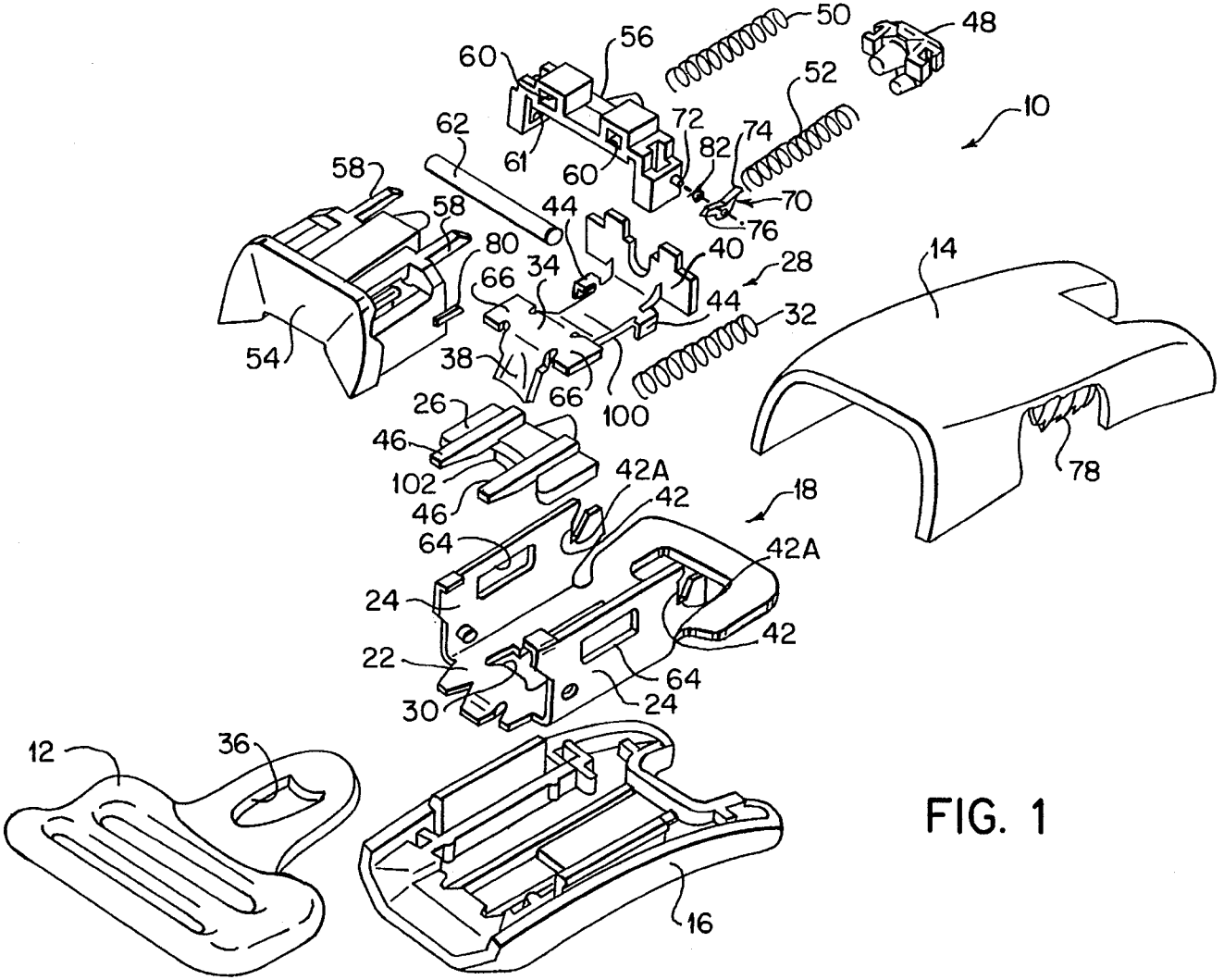
FIG. 1 is an exploded perspective view of one embodiment of a buckle apparatus of the present invention.
Figure 2:
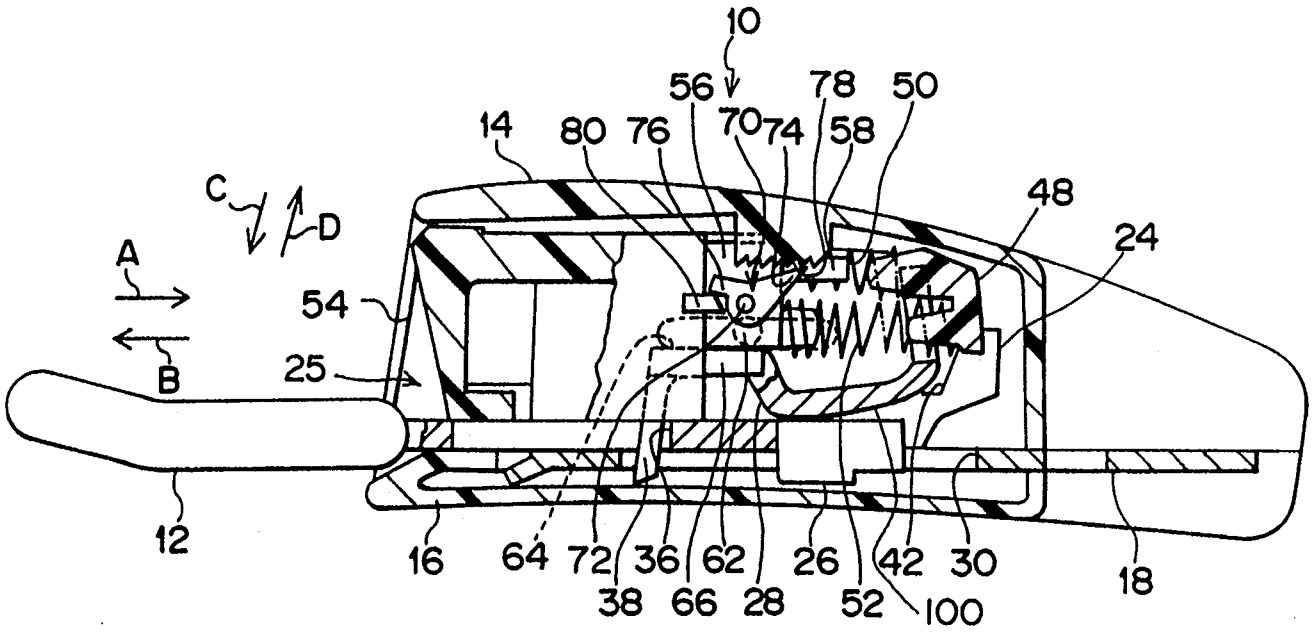
FIG. 2 is a schematic sectional view showing a tongue plate engaging state of the buckle apparatus of FIG. 1.
Figure 3:
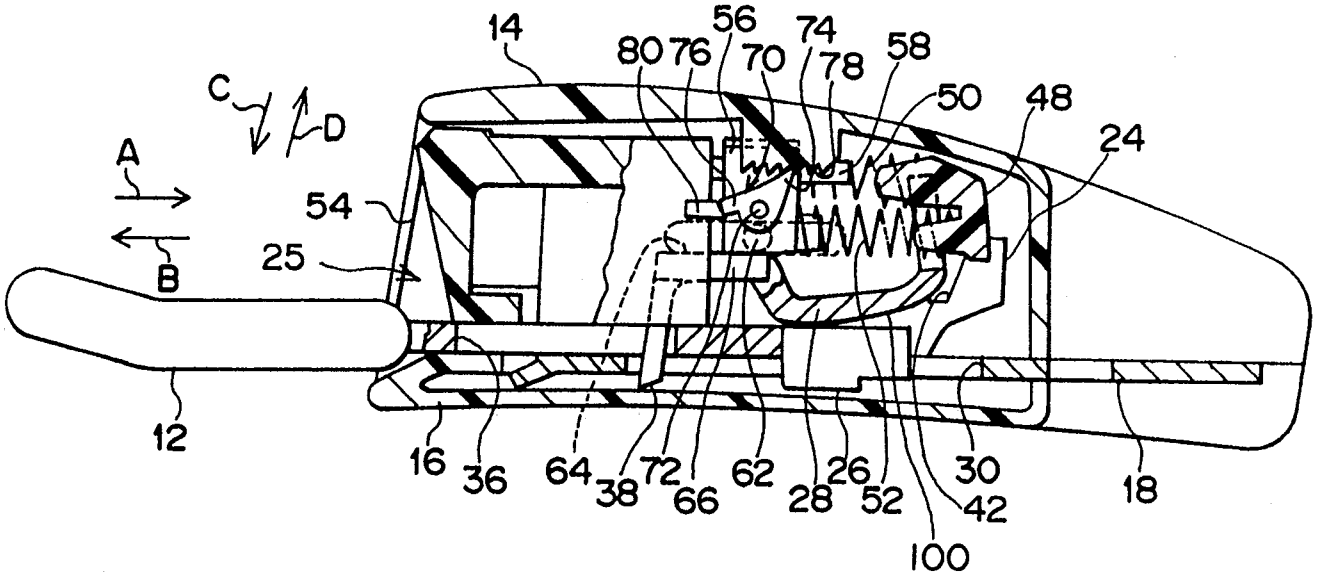
FIG. 3 is a schematic sectional view showing a lever engaging state of the buckle apparatus of FIG. 1.

FIGS. 1 to 3 illustrate a buckle apparatus 10 of the present invention, and a tongue plate 12 which is engagably inserted into the buckle apparatus 10.

In the buckle apparatus 10, a buckle body 18 is arranged between an upper cover 14 and a lower cover 16. In FIG. 1, the tongue plate 12 is inserted into the buckle apparatus 10 from the left side of the drawing (hereafter referred to as tongue plate inserting side). A webbing (not shown) is coupled to an end of the buckle apparatus 10 on the right side of the drawing (hereafter referred to as webbing coupled side). The buckle body 18 is provided with a pair of leg plate portions 24 which are bent on both sides of a flat plate portion 22 in a lateral direction. The tongue plate 12 is inserted between the pair of leg plate portions 24 through an opening 25 provided between the upper cover 14 and the lower cover 16.

An ejector 26 and a lock plate 28 are arranged between the pair of leg plate portions 24 of the buckle body 18.

The ejector 26 is inserted into a guide hole 30 which is provided in the flat plate portion 22 of the buckle body 18 so as to be movable in the tongue plate insertion direction (i.e., in a direction shown by the arrow A in FIGS. 2 and 3) and in the tongue plate removal direction (i.e., in a direction shown by the arrow B in FIGS. 2 and 3). An end of the ejector 26 on the webbing coupled side is fitted with one end of a compression coil spring 32. The other end of the compression coil spring 32 is secured to the buckle body 18. Consequently, the ejector 26 is urged by the compression coil spring 32 in the tongue plate removal direction (i.e., in the direction shown by the arrow B in FIGS. 2 and 3).

The ejector 26 is provided with a portion 102 which contacts a distal end of the tongue plate 12 when inserting the tongue plate 12. When the tongue plate 12 is inserted into the buckle body 18 as shown in FIG. 2, the tongue plate 12 presses the contact portion 102 of the ejector 26 so as to move the ejector 26.

The lock plate 28 extends longitudinally in the tongue plate insertion and removal directions and has a distal end portion, i.e., the end on the tongue plate inserting side orthogonally bent downward to form a substantially U-shaped portion 34. The distal end of the U-shaped portion 34 serves as an engaging portion 38 for engaging an engaging hole 35 in the tongue plate 12. The engaging portion 38 is fitted into the engaging hole 36 of the tongue plate 12 for engagement with the tongue plate 12.

A rising portion 40 extends upward from an end of the lock plate 28 on the side opposite the U-shaped portion 34 (i.e., on the webbing coupled side). The rising portion 40 has a width wider than that of the lock plate 28 in the lateral direction of the lock plate 28. Both lateral ends of the rising portion 40 are supported by the pair of leg plate portions 24 of the buckle body 18 so that the lock plate 28 is disposed between the leg plate portions 24. Substantially triangular notches 42 are provided in ends of the leg plate portions 24 on the webbing coupled side. Both lateral ends of the rising portion 40 of the lock plate 28 are inserted into the notches 42. Therefore, the lock plate 28 is swingable with top portions 42A of the notches 42 as a center of swinging in two directions shown by the arrows C and D in FIGS. 2 and 3. In the direction shown by the arrow C in FIGS. 2 and 3 (hereafter briefly referred to as engaging direction), the engaging portion 38 engages the engaging hole 36 of the tongue plate 12. Further, in the direction shown by the arrow D in FIGS. 2 and 3 (hereafter briefly referred to as releasing direction), the engaging portion 38 is released from the engaging hole 36 of the tongue plate 12.

When the tongue plate 12 is being removed, the distal end of the engaging portion 38 is in contact with an upper surface of the ejector 26 so that the lock plate 28 is swung in the releasing direction (i.e., in the direction shown by the arrow D in FIG. 2).

Further, bent portions 44 extending downward are provided at longitudinal intermediate portions of the lock plate 28 between the U-shaped portion 34 and the rising portion 40. The bent portions 44 are opposite the ends of blocks 46 on the webbing coupled side on the upper surface of the ejector 26. The block 46 extends in the tongue plate insertion and removal directions. When the tongue plate 12 is inserted, the ejector 26 is moved in the tongue plate insertion direction so as to push the bent portions 44 in the tongue plate insertion direction so as to swing the lock plate 28 in the engaging direction. The lock plate 28 engages the tongue plate 12 by this swinging and by the engaging hole 36 of the tongue plate 12 reaching the distal end of the engaging portion 38.

A spring holder 48 is provided for the lock plate 28 and is secured by the rising portion 40. One of the ends of compression coil springs 50 and 52 are respectively fitted to the spring holder 48. The other ends of the two compression coil springs 50, 52 are respectively fitted to the release button 54 and a lock pin holder 56. The release button 54 and the lock pin holder 56 are respectively urged by the compression coil springs 50 and 52 in the tongue plate removal direction.

The release button 54 is provided on the tongue plate inserting side with respect to the lock pin holder 56, and is movable in the tongue plate insertion direction against the urging force of the compression coil spring 50. At an end of the release button 54 on the webbing coupled side, blocks 58 extend toward the webbing coupled side. The blocks 58 movably pass in an axial direction through rectangular holes 60 which are provided in upper ends of the lock pin holder 56. When the release button 54 is pressed against the urging force of the compression coil spring 50 in the tongue plate insertion direction, the blocks 58 contact upper ends of the rising portion 40 of the lock plate 28. Subsequently, the blocks 58 press the rising portion 40 of the lock plate 28 so as to swing the lock plate 28 in the releasing direction. The lock plate 28 is swung so that the engaging portion 38 of the tongue plate 12 is removed from the engaging hole 36 of the tongue plate 12.

The lock pin holder 56 is urged by the compression coil spring 52 on the tongue plate inserting side, that is, in a direction of the release button 54. The lock pin holder 55 is provided with holding holes 61 for holding both ends of a lock pin 62. Horizontally elongated bearing holes 64 are provided in the leg plate portions 24 of the buckle body 18. The lock pin 52 passes through the bearing holes 64, and is supported by the holding holes 61 of the lock pin holder 56 outside the leg plate portions 24. Therefore, the lock pin 52 is supported by the bearing holes 64 so as to be movable in the tongue plate insertion and removal directions.

An intermediate portion of the U-shaped portion 34 serves as a positioning plate portion 66 extending in the lateral direction of the lock plate 28. The lock pin 62 is positioned on an upper surface of the positioning plate portion 66 in a state where the tongue plate is engaged. The lock pin 62 is positioned on a connecting portion 100 for connecting the U-shaped portion 34 and the rising portion 40 in a state where the tongue plate is removed. There is provided a locked condition where the lock plate 28 is prevented from swinging in the releasing direction in case the lock pin 62 is positioned on the upper surface of the positioning plate portion 66. On the other hand, the release button 54 is moved in the tongue plate insertion direction to move the lock pin 62 with the lock pin holder 56 in the tongue plate insertion direction. Accordingly, the lock pin 62 is positioned on the connecting portion. In this condition, there is provided a release condition where the lock pin 62 allows the lock plate 28 to swing in the releasing direction.

A lever 70 serving as an engaging claw member is rotatably supported by a supporting pin 72 on a side wall portion of the lock pin holder 56. Further, a helical coil spring 82 is mounted around the supporting pin 72.

A claw portion 74 and a cam portion 76 are respectively provided at ends of the lever 70. The claw portion 74 can engage teeth 78 which serve as engaging teeth provided on the upper cover 14. In a condition where the claw portion 74 engages the teeth 78, the lock pin holder 56 is prevented from moving in the tongue plate insertion direction. That is, the lock pin 62 is prevented from moving toward the release condition. The lever 70 is continuously urged by the helical coil spring 82 in a direction in which the claw portion 74 engages the teeth 78.

The cam portion 76 of the lever 70 contacts a projection 80 projecting from the release button 54 so as to block a rotation of the teeth 78. That is, the projection 80 contacts the cam portion 76 to hold the cam portion 76 so that the claw portion 74 of the lever 70 is separated from the teeth 78 of the upper cover 14 in a state where the release button 54 is close to the lock pin holder 56 (see FIG. 2). When the lock pin holder 56 is separated from the release button 54, the projection 80 holding the cam portion 76 is released so as to freely rotate the lever 70. Thereby, the lever 70 is rotated by the urging force of the helical coil spring 82 to engage the claw portion 74 with the teeth 78.

A description will now be given of the operation of the embodiment.

When the tongue plate 12 is inserted into the buckle apparatus 10, the distal end of the tongue plate 12 contacts and pushes the ejector 26 against the urging force of the compression coil spring 32 in the tongue plate insertion direction (in the arrow A of FIG. 2). The tongue plate 12 moves the ejector 26 in the tongue plate insertion direction. Along the way, the ejector 26 contacts the bent portions 44 of the lock plate 28 so as to press the bent portions 44 of the lock plate 28 in the tongue plate insertion direction. The ejector 26 moves in the tongue plate insertion direction so as to swing the lock plate 28 in the engaging direction (i.e., in the direction shown by the arrow C in FIG. 2). Accordingly, the engaging portion 38 of the lock plate 28 is fit into the engaging hole 36 when the tongue plate 12 is inserted into the buckle apparatus 10, and the engaging hole 36 of the tongue plate 12 is positioned directly below the engaging portion 38 of the lock plate 28.

At this time, tile lock pin 62 is movable in the tongue plate removal direction through the swinging of the lock plate 28. Consequently, the lock pin 62 is urged by the compression coil spring 52 through the lock pin holder 56 so as to move in the tongue plate removal direction. In a condition where the engaging portion 38 of the lock plate 28 is fit into the engaging hole 36 of the tongue plate 12, the lock pin 62 is positioned on the upper surface of the positioning plate portion 66, resulting in the locked condition (which is shown in FIG. 2).

Therefore, in the tongue plate engaging state shown in FIG. 2, the lock plate 28 is prevented by the lock pin 62 from swinging in the releasing direction (i.e., in the direction shown by the arrow D in FIG. 2). Hence, the engaging portion 38 of the lock plate 28 is prevented from being disengaged from the engaging hole 36 of the tongue plate 12. As a result, the tongue plate 12 is not inadvertently removed from the buckle apparatus 10.

The lock pin holder 55 is close to the release button 54, and the cam portion 76 of the lever 70 contacts the projection 80 to be held thereby in a state where the lock plate 28 prevents the tongue plate 12 from being removed, that is, in the locked condition in which the lock pin 62 is moved in the tongue plate removal direction. Accordingly, the claw portion 74 of the lever 70 is spaced apart from the teeth 78 of the upper cover 14. Hence, the lock pin holder 56 and the lock pin 62 are movable by pressing the release button 54.

It is assumed that the buckle apparatus 10 is in a state where the lock plate 28 prevents the tongue plate 12 from being removed, that is, in the locked condition where the lock pin 62 is moved in the tongue plate removal direction. In this condition, if an inertial force is exerted on the lock pin 62 in a direction for moving from the lock condition to the release condition (i.e., in the tongue plate insertion direction), the lock pin holder 56 is separated along with the lock pin 62 from the release button 54 so as to move in the tongue plate insertion direction. Thus, the cam portion 76 of the lever 70 mounted on the lock pin holder 56 is disengaged from the projection 80, and the projection 80 holding the cam portion 76 is released so the lever 70 can be rotated. Further, the lever 70 is rotated by the urging force of the helical coil spring 82 to engage the claw portion 74 with the teeth 78. As a result, the lock pin holder 56 is prevented from moving, and the lock pin 62 is not moved from the locked condition to the release condition (i.e., the lock pin 62 being in a state shown in FIG. 3).

As set forth above, even if exerting the inertial force in the direction for moving the lock pin 62 from a locked position to a release position, the lock pin 62 is prevented from moving so as to reliably maintain the locked condition of the lock pin 62.

Thereafter, if no inertial force is exerted, the lock pin holder 56 is urged by the compression coil spring 52 in the tongue plate removal direction. Accordingly, the lock pin holder 56 is moved in the direction of the release button 54, and the cam portion 76 is rotated counterclockwise while climbing up a distal end of the projection 80. Consequently, the claw portion 74 is removed from the teeth 78. Thus, the lock pin holder 56 can return to an original condition where the lock pin holder 56 is in contact with the release button 54.

On the other hand, when the tongue plate 12 is released from the buckle apparatus 10, the release button 54 is close to the lock pin holder 56, and the claw portion 74 of the lever 70 is separated from the teeth 78 of the upper cover 14. That is, the lock pin holder 56 is in a movable state. Hence, it is possible to press the release button 54 in a state shown in FIG. 2 against the urging force of the compression coil spring 50 in the tongue plate insertion direction so as to move the lock pin holder 56. In other words, when the release button 54 moves, the release button 54 presses the lock pin holder 56, and the lock pin holder 56 is moved against tile urging force of the compression coil springs 50 and 52 in the tongue plate insertion direction. The lock pin 62 is moved on the webbing coupled side with respect to the positioning plate portion 66 of the lock plate 28 due to the movement of the lock pin holder 56. Further, the blocks 58 of the release button 54 contact the upper ends of the rising portion 40 of the lock plate 28. Subsequently, the release button 54 presses the rising portion 40 of the lock plate 28 in the tongue plate insertion direction so as to swing the lock plate 28 in the releasing direction (i.e., in the direction shown by the arrow D in FIG. 2). The engaging portion 38 is disengaged from the engaging hole 36 of the tongue plate 12 due to the swinging of the lock plate 28. Concurrently, the ejector 26 is urged by the compression coil spring 32 to move in the tongue plate removal direction, and the ejector 26 presses the tongue plate 12 so as to be ejected out of the buckle apparatus 10. The release button 54 then returns to the condition shown in FIG. 2. In such a way, it is possible to perform the operation for releasing the engaging of the tongue plate as in the conventional buckle apparatus.

As set forth above, in the buckle apparatus 10, it is not necessary to simply increase the urging force of the spring of employ an additional spring in order to hold the lock pin 62 in the locked condition. Therefore, it is possible to reliably hold the lock plate 28 in the tongue plate engaging state by the lock pin 62 without the need of a stronger release operating force for releasing the tongue plate 12.

In the embodiment, the teeth 78 serving as engaging teeth are provided on the upper cover 14. However, it must be noted that the present invention should not be limited to the embodiment. The teeth may be provided on the buckle body 18. In this case, the claw portion 74 of the lever 70 engages the teeth so as to prevent the lock pin holder 56 from moving if inertial force is exerted in the direction for moving the lock pin 62 from the locked condition to the release condition. As a result, it is also possible to reliably hold the lock pin 62 in the locked condition without moving the lock pin 62 from the locked condition to the release condition.

Figure 4:
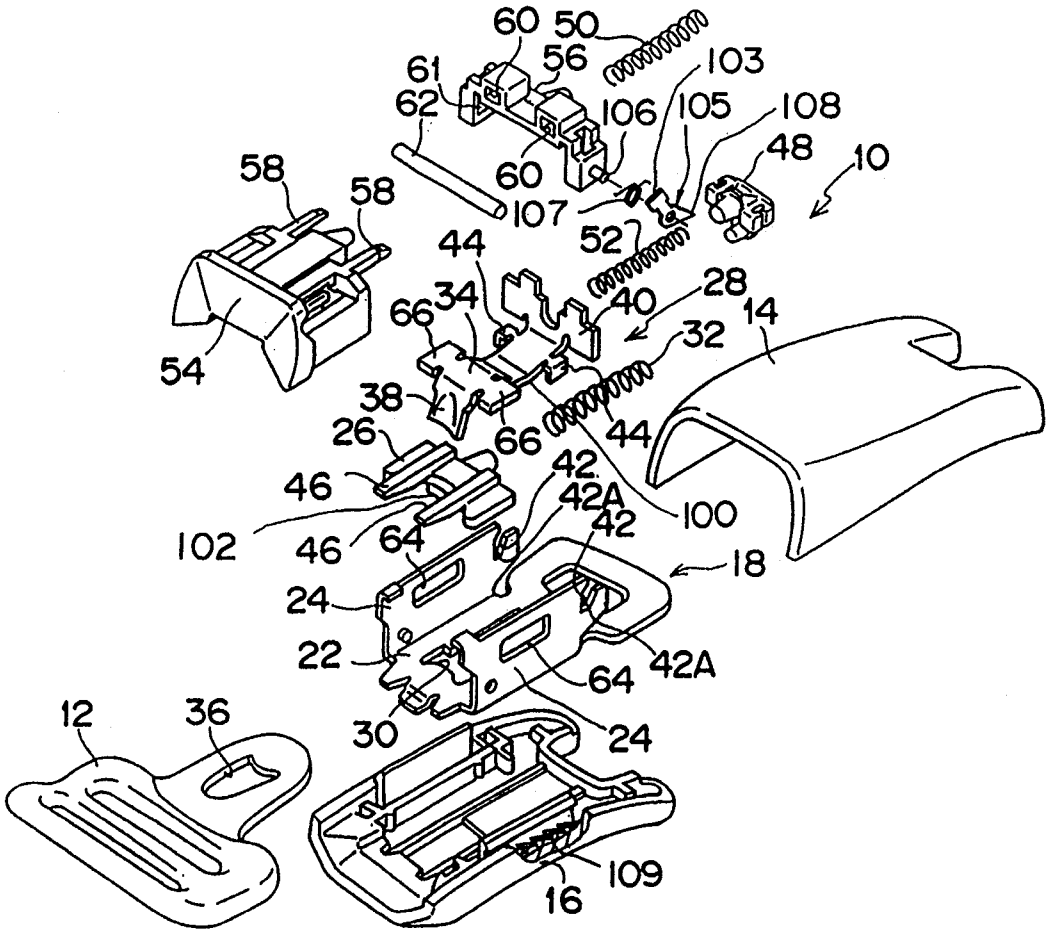
FIG. 4 is an exploded perspective view of another embodiment of the buckle apparatus of the present invention.
Figure 5:
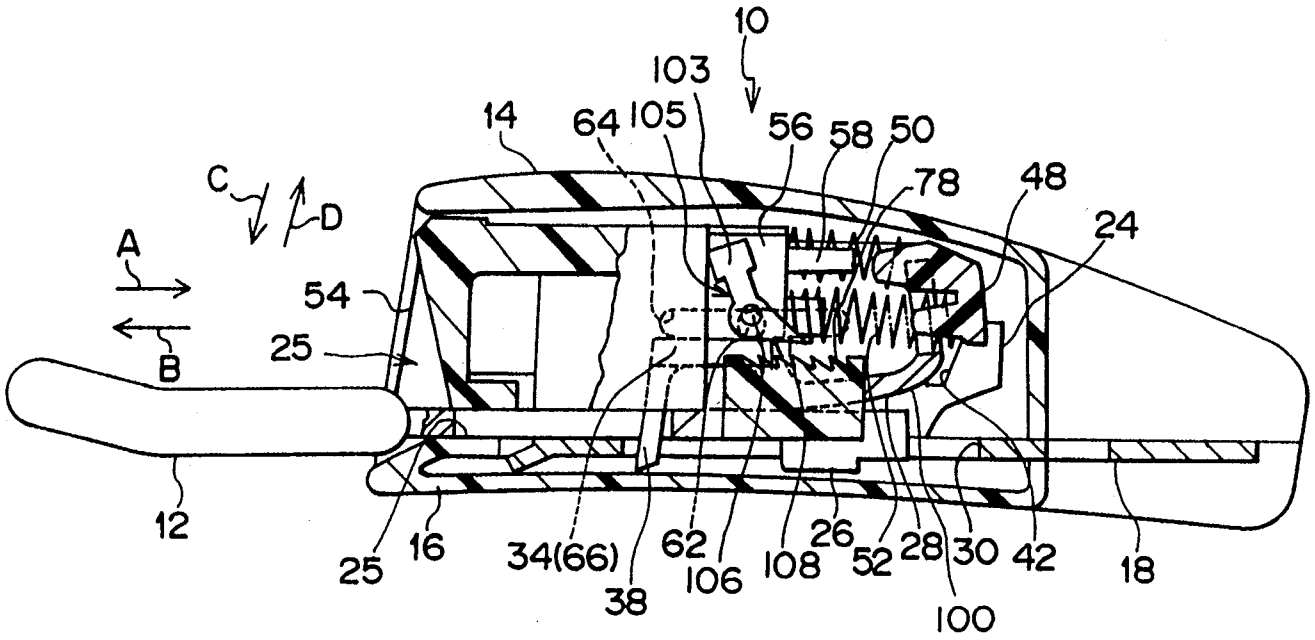
FIG. 5 is a schematic sectional view showing a tongue plate engaging state of the buckle apparatus of FIG. 4.
Figure 6:
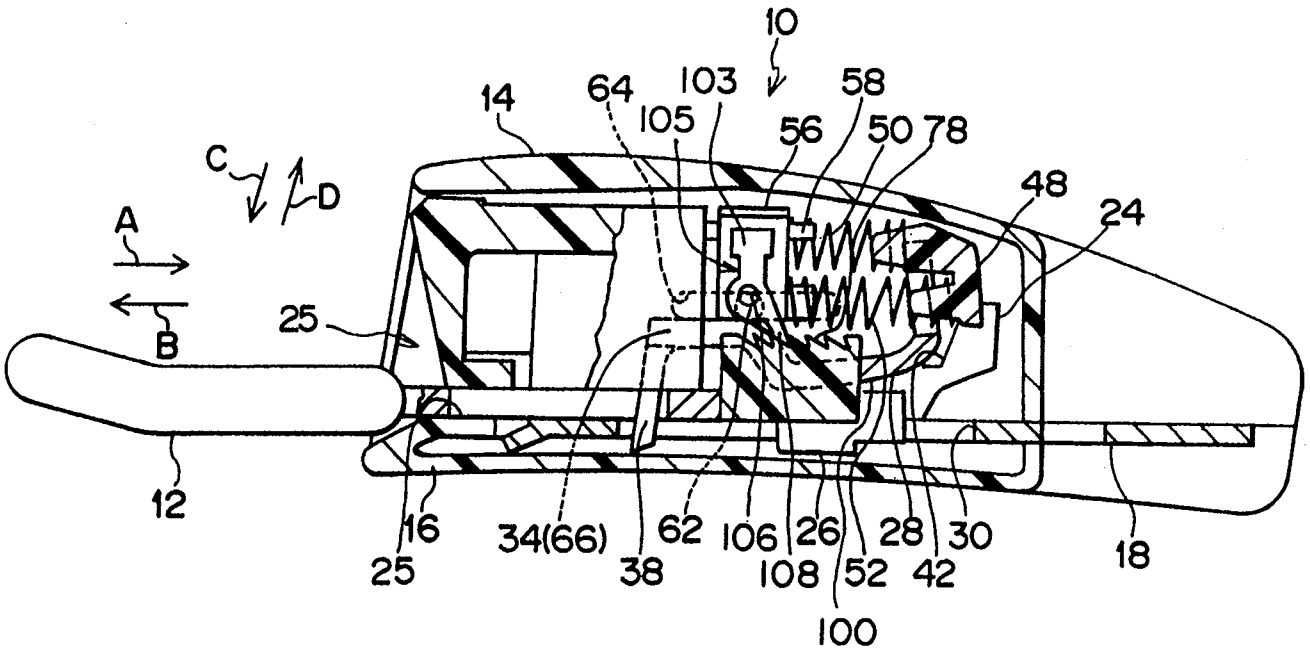
FIG. 6 is a schematic sectional view showing a lever engaging state of the buckle apparatus of FIG. 4.

Referring to FIGS. 4 to 6, a description will now be given of another embodiment of the buckle apparatus of the present invention. The structures and operations of the lock plate 28, the lock pin 62, the ejector 26, the tongue plate 12, the buckle body 18, and the lock pin holder 56 are identical with those in the previous embodiment, and a description of the structures and operations is omitted.

In the embodiment, a lever 105 serving as an inertial claw (engaging) member is rotatably supported by a supporting pin 106 at a side wall portion of the lock pin holder 56. Further, a helical coil spring 107 is mounted around the supporting pin 106.

A claw portion 108 is provided at one end of the lever 105, and a mass portion 103 is provided at the other end thereof. The claw portion 108 has a tapered end extending in a direction which is slightly rotated counterclockwise with respect to a prolongation extending from the mass portion 103 across the supporting pin 106. The mass portion 103 of the lever 105 is defined as, for example, an inertial mass portion in which a deadweight such as lead is embedded. Therefore, the mass portion 103 receives a large inertial force. On the other hand, corrugated teeth 109 are provided at a side wall portion of the lower cover 16 along the tongue plate insertion and removal directions. The claw portion 108 of the lever 105 can engage the teeth 109. In a condition where the claw portion 108 engages the teeth 109, the lock pin holder 56 is prevented from moving in the tongue plate insertion direction, that is, the lock pin 62 is prevented from moving to the release condition. The lever 105 is continuously urged by the helical coil spring 107 in a direction in which the claw portion 108 is separated from the teeth 109, that is, in a counterclockwise direction.

In the locked condition of the lock pin 62 where the lock pin holder 56 is close to the release button 54, the helical coil spring 107 causes the mass portion 103 of the lever 105 to contact the release button 54 so as to block the rotation of the mass portion 103 (in this state, the claw portion 108 of the lever 105 is held apart from the teeth 109). When the mass portion 103 receives the inertial force in the tongue plate insertion direction (that is, in the release direction of the lock pin 62), the lever 105 is rotated against the urging force of the helical coil spring 107 so as to engage the claw portion 108 with the teeth 78.

A description will now be given of the operation of the embodiment.

When the tongue plate 12 is inserted into the buckle apparatus 10, the distal end of the tongue plate 12 contacts the ejector 26 to press the ejector 26 against the urging force of the compression coil spring 32 in the tongue plate insertion direction (in the arrow A of FIG. 5). The tongue plate 12 moves the ejector 26 in the tongue plate insertion direction. Along the way, the ejector 26 contacts and presses the bent portions 44 of the lock plate 28 in the tongue plate insertion direction. The ejector 26 moves in the tongue plate insertion direction so as to swing the lock plate 28 in the engaging direction (i.e., in the direction shown by the arrow C in FIG. 5). Accordingly, when the tongue plate 12 is inserted into the buckle apparatus 10 and the engaging hole 36 of the tongue plate 12 is positioned directly below the engaging portion 38 of the lock plate 28, the engaging portion 38 of the lock plate 28 is fit into the engaging hole 36.

At this time, the lock pin 62 is movable in the tongue plate removal direction through the swinging of the lock plate 28. Consequently, the lock pin 62 is urged by the compression coil spring 52 through the lock pin holder 56 so as to move in the tongue plate removal direction. In a condition where the engaging portion 38 of the lock plate 28 is fit into the engaging hole 36 of the tongue plate 12, the lock pin 62 is positioned on the upper surface of the positioning plate portion 66, resulting in the locked state (which is shown in FIG. 5).

Therefore, in the tongue plate engaging state shown in FIG. 5, the lock plate 28 is prevented by the lock pin 62 from swinging in the releasing direction (i.e., in the direction shown by the arrow D in FIG. 5). Hence, the engaging portion 38 of the lock plate 28 is prevented from being disengaged from the engaging hole 36 of the tongue plate 12. As a result, the tongue plate 12 is not inadvertently removed from the buckle apparatus 10.

The mass portion 103 of the lever 105 attached to the lock pin holder 56 is in contact with the release button 54 in a state where the tongue plate 28 prevents the tongue plate 12 from being removed, that is, in the locked condition in which the lock pin 52 is moved in the tongue plate removal direction. Accordingly, the claw portion 108 is separated from the teeth 109 of the lower cover 16. Hence, the lock pin holder 56 and the lock pin 62 are movable by pressing the release button 54.

It is assumed that the buckle apparatus 10 is in a state where the lock plate 28 prevents the tongue plate 12 from being removed, that is, in the locked condition where the lock pin 62 is moved in the tongue plate removal direction. In this condition, if inertial force is exerted on the lock pin 62 in a direction for moving from the lock condition to the release condition (i.e., in the tongue plate insertion direction), the lock pin holder 56 is separated, together with the lock pin 62, from the release button 54 so as to move in the tongue plate insertion direction. However, the inertial force exerted on the lock pin 62 is also exerted on the mass portion 103 of the lever 105. Therefore, the lever 105 is rotated against the urging force of the helical coil spring 107 about the supporting pin 106 so as to engage the claw portion 108 with the teeth 109. As a result, the lock pin holder 56 is prevented from moving, and the lock pin 62 is not moved from the locked condition to the release condition (see FIG. 6).

As set forth above, even if exerting inertial force in the direction for moving the lock pin 62 from a locked position to a release position, the lock pin 62 is prevented from moving so as to reliably maintain the locked condition of the lock pin 62.

Thereafter, if no inertial force is exerted, the lock pin holder 56 is urged by the compression coil spring 52 in the tongue plate removing direction. Accordingly, the lock pin holder 56 is moved in the direction of the release button 54, and the mass portion 103 is rotated counterclockwise by the urging force of helical coil spring 107. As a result, the claw portion 108 of the lever is separated from the engaging teeth 109. Thus, the lock pin holder 56 can return to an original condition where the holder 56 is in contact with the release button 54.

On the other hand, when the tongue plate 12 is released from the buckle apparatus 10, the claw portion 108 of the lever 105 attached to the lock pin holder 56 is separated from the teeth 109 of the lower cover 16. That is, the lock pin holder 56 is in a movable state. Hence, it is possible to press the release button 54 in a state shown in FIG. 5 against the urging force of the compression coil spring 50 in the tongue plate insertion direction so as to move the lock pin holder 56. In other words, when the release button 54 moves, the release button 54 presses the lock pin holder 56, and the lock pin holder 56 is moved against the urging force of tile compression coil springs 50 and 52 in the tongue plate insertion direction. The lock pin 62 is moved on the webbing coupled side with respect to the positioning plate portion 66 of tile lock plate 28 due to the movement of the lock pin holder 56. Further, the blocks 58 of the release button 54 contact the upper ends of the rising portion 40 of the lock plate 28. Subsequently, the release button 54 presses the rising portion 40 of the lock plate 28 in the tongue plate insertion direction so as to swing the lock plate 28 in the releasing direction (i.e., in the direction shown by the arrow D in FIG. 5). In this process, the lock pin 62 is moved from an upper surface of the positioning plate portion 66 onto the connecting portion 100. The engaging portion 38 is disengaged from the engaging hole 36 of the tongue plate 12 due to the swinging of the lock plate 28. Concurrently, the ejector 26 is urged by the compression coil spring 32 to move in the tongue plate removal direction, and the ejector 26 presses the tongue plate 12 so as to be ejected out of the buckle apparatus 10. The release button 54 then returns to the condition shown in FIG. 5 again. In this way, it is possible to perform the operation for releasing the tongue plate as in the conventional buckle apparatus.

As set forth above, in the buckle apparatus 10, it is not necessary to simply increase the urging force of the spring of employ an additional spring in order to hold the lock pin 62 in the locked condition. Therefore, it is possible to reliably hold the lock plate 28 in the tongue plate engaging state by the lock pin 62 without a stronger release operating force for releasing the tongue plate 12.

In the embodiment, the teeth 109 serving as engaging teeth are provided at the lower cover 16. However, it must be noted that the present invention should not be limited to the embodiment, and the teeth may be provided at an upper cover 14 or the buckle body 18. In this case, it is also possible to obtain the same effects as set forth above.

Further, the lever 105 is urged by using the helical coil spring 82 in the embodiment. However, the lever 105 may be urged by coupling the mass portion 103 or the claw portion 108 of the lever 105 with a coil spring 107 which is supported by the lock pin holder 56.

As described hereinbefore, in the buckle device of the present invention, there are excel lent effects in that stronger release operating force is not required for releasing the tongue plate, and the lock plate can be reliably maintained by the lock pin in the tongue plate engaging state.

What is claimed is:

1. A buckle apparatus comprising:

a buckle body covered with a cover;

a tongue plate insertable into and removable from said buckle body;

a lock plate supported by said buckle body so as to engage said tongue plate inserted thereinto, said lock plate being swingable between a first position for engaging said tongue plate and a second position for releasing said engagement;

a lock pin held by a holder and positioned in contact with said lock plate, said lock pin being movable in tongue plate insertion and removal directions, said lock pin moving in said tongue plate removal direction so as to prevent said lock plate from swinging toward said second position, and moving in said tongue plate insertion direction so as to allow said lock plate to swing toward said second position;

a release button supported by said buckle body for pressing said holder to move said lock pin in said tongue plate insertion direction;

teeth provided on one of said cover and said buckle body;

an engaging member attached to said holder and being engagable with said teeth; and means for engaging said engaging member with said teeth when inertial force acts to move said lock pin in said tongue plate insertion direction.

2. A buckle apparatus according to claim 1, wherein said engaging means includes a mass portion which is secured to said engaging member and which rotates said engaging member by an inertial force so as to engage the tip of said engaging member with said teeth, and urging means for urging said engaging member in a direction for removing said engaging member from said teeth.

3. A buckle apparatus according to claim 1, wherein said engaging means includes a projection provided at a back portion of said release button, a cam portion secured to said engaging member and being able to contact said projection, and urging means for urging the tip of said engaging member in a direction in which said tip of the engaging member engages said teeth.

4. A buckle apparatus comprising:

a buckle body covered with a cover;

a tongue plate insertable into and removable from said buckle body;

a lock plate supported by said buckle body so as to engage said tongue plate inserted thereinto, said lock plate being swingable between a first position for engaging said tongue plate and a second position for releasing said engagement;

a lock pin positioned in contact with said lock plate, said lock pin being movable in tongue plate insertion and removal directions, said lock pin moving in said tongue plate removal direction so as to prevent said lock plate from swinging toward said second position, and moving in said tongue plate insertion direction so as to allow said lock plate to swing toward said second position;

a lock pin holder for holding said lock pin;

a release button supported by said buckle body for pressing said holder to move said lock pin in said tongue plate insertion direction;

teeth provided on one of said cover and said buckle body; and an engaging member attached to said holder, said engaging member being separated from said teeth when said holder is substantially in contact with said release button, and engaging Said teeth when said holder is separated from said release button.

5. A buckle apparatus according to claim 4, wherein said engaging member is a lever rotatably supported by a shaft at a side wall of said holder and having a claw portion and a cam portion disposed at opposing sides of the shaft.

6. A buckle apparatus according to claim 5, wherein said claw portion of said lever is urged in a direction in which said claw portion engages said engaging teeth, said lever being prevented from rotating by said cam portion contacting a projection provided on said release button so as to separate said claw portion from said teeth in a state where said holder is substantially in contact with said release button, and said cam portion being separated from said projection to engage said claw portion with said teeth so as to prevent said holder from moving in a state where said holder is separated from said release button.

7. A buckle apparatus according to claim 5, wherein a helical spring is provided around said shaft of the lever so as to urge said claw portion of said lever in a direction in which said claw portion engages said teeth.

8. A buckle apparatus according to claim 4, wherein said lock plate includes a U-shaped portion bent downward in a U-shaped configuration at an end of said lock plate on a tongue plate inserting side, a rising portion bent upward at another end thereof, and a connecting portion for connecting said U-shaped portion and said rising portion, a distal end of said U-shaped portion serving as an engaging portion for engaging an engaging hole of said tongue plate, said lock pin being positioned at an intermediate portion of said U-shaped portion when said lock plate is held in said first position, and said lock pin being positioned at said connecting portion when said lock plate is held in said second position.

9. A buckle apparatus according to claim 4, wherein said lock pin holder is urged by a spring to be in contact with said release button in a normal condition.

10. A buckle apparatus comprising:

a buckle body covered with a cover;

a tongue plate insertable into and removable from said buckle body;

a lock plate supported by said buckle body so as to engage said tongue plate inserted thereinto, said lock plate being swingable between a first position for engaging said tongue plate and a second position for releasing said engagement;

a lock pin positioned in contact with said lock plate, said lock pin being movable in tongue plate insertion and removal directions, said lack pin moving in said tongue plate removal direction so as to prevent said lack plate from swinging toward said second position, and moving in said tongue plate insertion direction so as to allow said lack plate to swing toward said second position;

a lack pin holder for holding said lack pin;

a release button supported by said buckle body for pressing said holder to move said lack pin in said tongue plate insertion direction;

teeth provided on one of said cover and said buckle body; and an inertial engaging member attached to said holder and having a mass portion, said inertial engaging member moving to engage said teeth when inertial force acts to move said inertial engaging member.

11. A buckle apparatus according to claim 10, wherein said engaging member is a lever rotatably supported by a shaft at a side wall of said holder and having a mass portion and a claw portion disposed at opposing sides of the shaft.

12. A buckle apparatus according to claim 11, wherein said claw portion of said lever is urged in a direction in which said claw portion engages said engaging teeth, said lever being prevented from rotating by said mass portion contacting a back portion of said release button so as to separate said claw portion from said teeth in a state where said holder is substantially in contact with said release button, and said mass portion being rotated and moved by inertial force to engage said claw portion with said teeth so as to prevent said holder from moving when inertial force acts in said tongue plate insertion direction.

13. A buckle apparatus according to claim 11, wherein a helical spring is provided around said shaft of the lever so as to urge said claw portion of said lever in a direction away from said teeth.

14. A buckle apparatus according to claim 11, wherein a coil spring is provided to couple said lever with said holder so as to urge said claw portion of said lever in a direction away from said teeth.

15. A buckle apparatus according to claim 10, wherein said lock plate includes a U-shaped portion bent in a U-shaped configuration at an end of said lock plate on a tongue plate inserting side, a rising portion upward bent at the other end thereof, and a connecting portion for coupling said U-shaped portion and said rising portion, a distal end of said U-shaped portion serving as an engaging portion for engaging an engaging hole of said tongue plate, said lock pin being positioned on an intermediate portion of said U-shaped portion when said lock plate is held at said first position, and said lock pin being positioned on said connecting portion when said lock plate is held at said second position.

16. A buckle apparatus according to claim 10, wherein said lock pin holder is urged by a spring to be in contact with said release button in a normal condition.

17. A buckle apparatus according to claim 10 further comprising an ejector disposed to be movable in tongue plate insertion and removal directions on said buckle body, said ejector being moved by said tongue plate when said tongue plate is inserted into said buckle body, and a distal end of said lock plate being at rest on an upper surface of said ejector when said tongue plate is being removed from said buckle body.

18. A buckle apparatus according to claim 10, wherein said buckle body includes a flat plate portion, and a pair of leg plate portions opposed to each other with said flat plate portion interposed between said leg plate portions, said leg plate portions having horizontally elongated bearing holes for respectively supporting an end of said lock pin movably in tongue plate insertion and removal directions.

19. A buckle apparatus according to claim 10, provided for use in seat belt systems.

* * * * *